US010813433B2

(12) United States Patent
Thorpe et al.

(10) Patent No.: US 10,813,433 B2
(45) Date of Patent: Oct. 27, 2020

(54) MAGNETIC LID AND ASSEMBLY

(71) Applicant: HCT GROUP HOLDINGS LIMITED, Central (CN)

(72) Inventors: Timothy Thorpe, Santa Monica, CA (US); Adrian Apodaca, Daly City, CA (US); Stephen Burditt, Los Angeles, CA (US); Stephen Chen, Los Angeles, CA (US); Jenny Hsu, Santa Monica, CA (US)

(73) Assignee: HCT GROUP HOLDINGS LIMITED, Hong Kong (CN)

( * ) Notice: Subject to any disclaimer, the term of this patent is extended or adjusted under 35 U.S.C. 154(b) by 139 days.

(21) Appl. No.: 15/455,702

(22) Filed: Mar. 10, 2017

(65) Prior Publication Data

US 2017/0265625 A1 Sep. 21, 2017

Related U.S. Application Data

(60) Provisional application No. 62/309,041, filed on Mar. 16, 2016.

(51) Int. Cl.
*A45D 40/26* (2006.01)
*B65D 51/18* (2006.01)
(Continued)

(52) U.S. Cl.
CPC ..... *A45D 40/262* (2013.01); *A45D 33/006* (2013.01); *A45D 33/24* (2013.01); *A45D 33/26* (2013.01); *A45D 40/0068* (2013.01); *A45D 40/18* (2013.01); *B65D 1/10* (2013.01); *B65D 43/0225* (2013.01); *B65D 51/18* (2013.01); *B65D 51/246* (2013.01); *B65D 51/32* (2013.01);
(Continued)

(58) Field of Classification Search
CPC ..... A46B 15/0026; A46B 15/0095; B65D 51/32; B65D 41/0492; A45D 33/003
USPC ..... 401/123, 125, 128
See application file for complete search history.

(56) References Cited

U.S. PATENT DOCUMENTS 1,156,456 A 10/1915 Beck
1,357,306 A 11/1920 Atste
(Continued)

FOREIGN PATENT DOCUMENTS

JP 2004201970 A 7/2004
JP 2004331105 A 11/2004
(Continued)

OTHER PUBLICATIONS

International Search Report and Written Opinion dated Jun. 19, 2017 for International Application No. PCT/US2017/021810.
(Continued)

*Primary Examiner* — David P Angwin
*Assistant Examiner* — Bradley S Oliver
(74) *Attorney, Agent, or Firm* — Seager, Tufte & Wickhem LLP

(57) ABSTRACT

A jar and lid assembly that includes a jar assembly configured to hold a product. The jar and lid assembly also includes a lid assembly coupled to the jar assembly and includes an outer lid portion and an inner lid portion. The coupling of the lid assembly may be by rotation to secure the lid assembly using threads. A magnet may be positioned within the lid assembly to magnetically couple a cosmetic implement to an outer surface of the lid assembly.

20 Claims, 6 Drawing Sheets

(51) Int. Cl.

| | |
|---|---|
| ***B65D 51/24*** | (2006.01) |
| ***A45D 40/18*** | (2006.01) |
| ***A45D 33/24*** | (2006.01) |
| ***A45D 33/26*** | (2006.01) |
| ***B65D 51/32*** | (2006.01) |
| ***B65D 77/04*** | (2006.01) |
| ***A45D 33/00*** | (2006.01) |
| ***A45D 40/00*** | (2006.01) |
| ***B65D 1/10*** | (2006.01) |
| ***B65D 43/02*** | (2006.01) |
| ***B65D 55/00*** | (2006.01) |
| *A45D 26/00* | (2006.01) |

(52) U.S. Cl.

CPC ..... *B65D 55/00* (2013.01); *B65D 77/0486* (2013.01); *A45D 26/0066* (2013.01); *A45D 2200/1018* (2013.01); *B65D 2555/00* (2013.01)

(56) References Cited

U.S. PATENT DOCUMENTS

| | | | | |
|---|---|---|---|---|
| 1,373,622 | A * | 4/1921 | Lloyd | B65D 51/32 220/521 |
| D94,984 | S | 3/1935 | Noble | |
| 2,527,169 | A | 10/1950 | Wiggins | |
| 2,817,451 | A | 12/1957 | Giles et al. | |
| 2,850,194 | A * | 9/1958 | Williams | B65D 41/0492 215/334 |
| 3,147,511 | A * | 9/1964 | Pittoni | A45D 40/265 401/128 |
| D203,137 | S | 12/1965 | Braun | |
| 3,685,678 | A * | 8/1972 | Ritzenhoff | B65D 41/0407 215/334 |
| 4,597,501 | A * | 7/1986 | Gueret | B65D 41/0435 215/330 |
| D303,584 | S | 9/1989 | Bakic | |
| 5,598,929 | A | 2/1997 | Jensen et al. | |
| D432,224 | S | 10/2000 | Hautmann et al. | |
| 6,138,687 | A | 10/2000 | Sheffler et al. | |
| D442,338 | S | 5/2001 | Roman | |
| 6,588,958 | B1 | 7/2003 | Seidler | |
| 7,028,843 | B2 | 4/2006 | Byun | |
| 7,337,787 | B2 | 3/2008 | Matsuoka | |
| D581,279 | S | 11/2008 | Oates | |
| D582,772 | S | 12/2008 | Bakic | |
| D592,956 | S | 5/2009 | Thiellier | |
| D610,009 | S | 2/2010 | Prufer | |
| D615,867 | S | 5/2010 | Sagaseki | |
| D619,896 | S | 7/2010 | Iwazu | |
| 7,909,195 | B2 | 3/2011 | Rathbone | |
| 7,918,620 | B2 | 4/2011 | Del Ponte | |
| 7,959,369 | B2 | 6/2011 | Gueret | |
| D651,519 | S | 1/2012 | Gibson | |
| 8,132,578 | B2 | 3/2012 | LoPrete | |
| D661,989 | S | 6/2012 | Praster | |
| 8,210,187 | B1 | 7/2012 | Zhang | |
| 8,360,078 | B2 | 1/2013 | Lim et al. | |
| D691,888 | S | 10/2013 | Mettler | |
| 9,247,803 | B2 | 2/2016 | Lim et al. | |
| 2002/0056660 | A1 | 5/2002 | Gueret | |
| 2003/0154997 | A1 | 8/2003 | Lin | |
| 2003/0183240 | A1 | 10/2003 | Manougian et al. | |
| 2005/0011895 | A1 | 1/2005 | Lin | |
| 2006/0231117 | A1 | 10/2006 | Manougian et al. | |
| 2008/0078419 | A1 | 4/2008 | Hirst | |
| 2009/0205673 | A1 | 8/2009 | Richardson | |
| 2010/0017990 | A1 | 1/2010 | Piao | |
| 2016/0058069 | A1 | 3/2016 | Rushforth | |
| 2016/0083152 | A1 | 3/2016 | Eberlein | |

FOREIGN PATENT DOCUMENTS

| | | | |
|---|---|---|---|
| JP | 2016016879 | A | 2/2016 |
| KR | 1020060022242 | A | 3/2006 |
| KR | 20090104593 | A | 10/2009 |
| WO | 03082045 | A2 | 10/2003 |
| WO | 2006101339 | A1 | 9/2006 |
| WO | 2010042040 | A1 | 4/2010 |

OTHER PUBLICATIONS

Lekeus, "My Cosmetic Range" LeKeux HQ, retrieved on Feb. 24, 2015 at http://lekeuxhq.blogspot.com/2014/11/my-cosmetics-range.html, 6 Pages.

Extended European Search Report dated Aug. 26, 2019 for European Application No. 17767210.2.

* cited by examiner

MAGNETIC LID AND ASSEMBLY

CROSS REFERENCE TO RELATED APPLICATIONS

The present application claims the benefit of and priority to U.S. Provisional Patent Application Ser. No. 62/309,041, filed on Mar. 16, 2016, titled MAGNETIC LID AND ASSEMBLY, the disclosure of which is incorporated herein by reference.

TECHNOLOGY FIELD

The present application relates generally to a jar and lid assembly, and in particular, to a jar and lid assembly including a magnetic applicator.

BACKGROUND

Vessels exist that are portable, convenient to use, and designed to contain volatile and/or aggressive products for use. These types of portable vessels usually consist of ajar and lid assembly, that when assembled together provide an effective barrier for containing the volatile product. The airtight portable vessels may be designed to contain the volatile product with minimal weight loss. Moreover, the airtight portable vessels are designed to contain the volatile product with minimal environmental communication. The jar and/or lid are typically made of a glass, a plastic, a metal, combinations of the foregoing, or the like, that when closed together create an airtight seal. These jar and lid assemblies may be sealed by a thread fastening mechanism, a snap fastening mechanism, or a clamp fastening mechanism, that when fastened together usually compress an O-ring or a gasket interposed by the jar and the lid. Such vessels are used in the cosmetics and personal care industries for containing a product to be applied to a body, where, as described above, the product to be applied to the body may be volatile and/or aggressive. As such, without the vessel's effective barrier the product may degrade and/or expire. In some instances, an applicator may be provided with the vessel. Although portable vessels and applicators exist, there is a continuing need for more and different vessels and applicators.

SUMMARY

This disclosure provides design, material, manufacturing methods, and use alternatives for cosmetic packaging.

In a first example, a jar and lid assembly may comprise a jar configured to hold a product and having a circumferential edge disposed at a top of the jar and defining an opening, a lid releasably coupled to the jar assembly, the lid comprising a top portion having an outer surface and an inner surface and a laterally extending side, and a magnet disposed adjacent to the inner surface of the top portion of the lid.

Alternatively or additionally to any of the examples above, in another example, the jar and lid assembly may further comprise a cosmetic implement magnetically coupled to the outer surface of the top portion of the lid.

Alternatively or additionally to any of the examples above, in another example, at least a part of the cosmetic implement may be formed from a magnetic material.

Alternatively or additionally to any of the examples above, in another example, the cosmetic implement may comprise a handle and an applicator and at least one of the handle and the applicator of the cosmetic implement may be formed from a composite material including at least one magnetic material.

Alternatively or additionally to any of the examples above, in another example, the cosmetic implement may comprise a handle and an applicator and at least one of the handle and the applicator of the cosmetic implement may be formed from a polymeric material having a magnetic core.

Alternatively or additionally to any of the examples above, in another example, the magnet may be adhered to the inner surface of the top portion of the lid.

Alternatively or additionally to any of the examples above, in another example, the magnet may be embedded in the inner surface of the top portion of the lid.

Alternatively or additionally to any of the examples above, in another example, the jar and lid assembly may further comprise a recess formed in the outer surface of the top portion of the lid.

Alternatively or additionally to any of the examples above, in another example, the recess may have a generally uniform cross-section along a length of the recess.

Alternatively or additionally to any of the examples above, in another example, a cross-section of the recess may change along a length of the recess.

Alternatively or additionally to any of the examples above, in another example, the jar and lid assembly may further comprise one or more additional magnets disposed adjacent to the inner surface of the top portion of the lid.

Alternatively or additionally to any of the examples above, in another example, the jar and lid assembly may further comprise a liner disposed adjacent to the inner surface of the top portion of the lid and configured to contact the circumferential edge of the jar when the lid is in a closed position.

Alternatively or additionally to any of the examples above, in another example, the magnet may be positioned between the liner and the inner surface of the top portion of the lid.

Another example jar and lid assembly may comprise a jar configured to hold a product and having a circumferential edge disposed at a top of the jar and defining an opening, and a lid assembly releasably coupled to the jar assembly. The lid assembly may comprise an outer lid portion having an outer lid top portion having a recess molded therein, an inner lid portion having an inner lid top portion and a laterally extending inner lid side, and a magnet disposed adjacent to an inner surface of the outer lid portion. The jar and lid assembly may further comprise a cosmetic implement configured to be disposed in the recess, the cosmetic implement may be magnetically coupled to a top surface of the outer lid portion.

Alternatively or additionally to any of the examples above, in another example, a portion of the cosmetic implement may be formed from a magnetic material.

Alternatively or additionally to any of the examples above, in another example, a portion of the cosmetic implement may be formed from a composite material including at least one magnetic material.

Alternatively or additionally to any of the examples above, in another example, a portion of the cosmetic implement may be formed from a polymeric material having a magnetic core.

Alternatively or additionally to any of the examples above, in another example, the magnet may be adhered to the inner surface of the outer lid portion.

Alternatively or additionally to any of the examples above, in another example, the magnet may be embedded in the inner surface of the outer lid portion.

Alternatively or additionally to any of the examples above, in another example, the recess may have a generally uniform cross-section along a length of the recess.

Alternatively or additionally to any of the examples above, in another example, a shape of the recess may generally conform to a shape of the cosmetic implement.

Alternatively or additionally to any of the examples above, in another example, the jar and lid assembly may further comprise one or more additional magnets disposed between the inner lid portion and the outer lid portion.

Another example jar and lid assembly may comprise a jar configured to hold a product and having a circumferential edge disposed at a top of the jar and defining an opening and a lid assembly releasably coupled to the jar assembly. The lid assembly may comprise an outer lid portion having a generally planar outer lid top portion, an inner lid portion having an inner lid top portion and a laterally extending inner lid side, and a magnet disposed adjacent to an inner surface of the outer lid portion. A cosmetic implement may be configured to be disposed on the generally planar outer lid top portion, the cosmetic implement may be magnetically coupled to a top surface of the outer lid portion. At least a portion of the cosmetic implement may have a profile configured to rest against the generally planar outer lid top portion.

Alternatively or additionally to any of the examples above, in another example, a portion of the cosmetic implement may be formed from a magnetic material.

Alternatively or additionally to any of the examples above, in another example, a portion of the cosmetic implement may be formed from a composite material including at least one magnetic material.

Alternatively or additionally to any of the examples above, in another example, a portion of the cosmetic implement may be formed from a polymeric material having a magnetic core.

Alternatively or additionally to any of the examples above, in another example, the magnet may be adhered to the inner surface of the outer lid portion.

Alternatively or additionally to any of the examples above, in another example, the magnet may be embedded in the inner surface of the outer lid portion.

Alternatively or additionally to any of the examples above, in another example, the jar and lid assembly may further comprise one or more additional magnets disposed between the inner lid portion and the outer lid portion.

The above summary of some example embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF EXEMPLARY EMBODIMENTS

Figure 1:
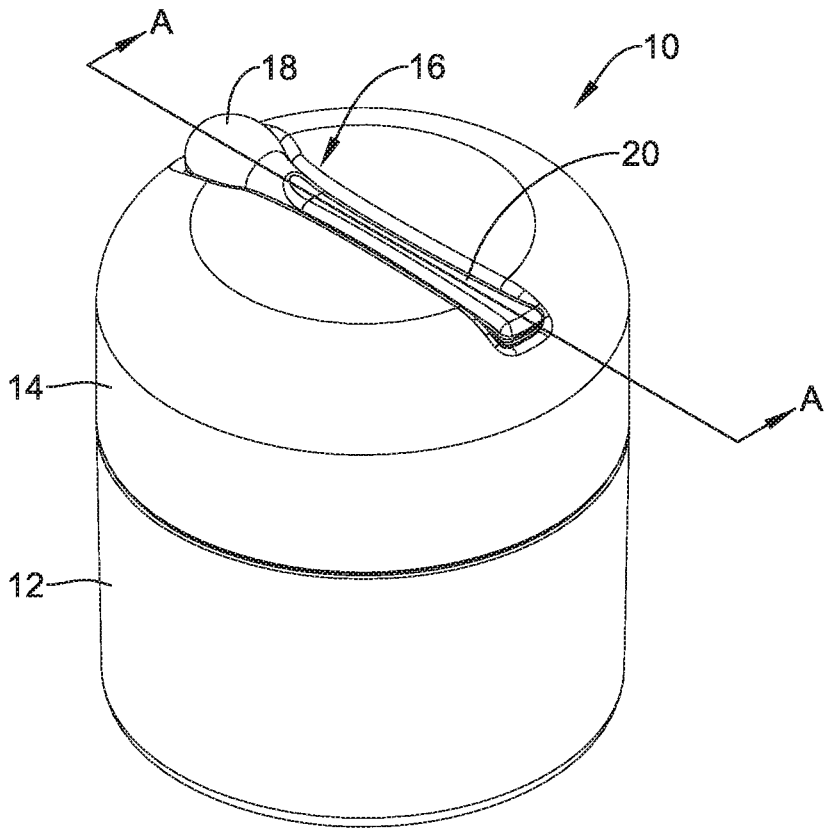
FIG. 1 is a perspective view of an illustrative jar and lid assembly.

FIG. 1 is a perspective view of ajar and lid assembly 10 according to embodiments disclosed herein. As shown at FIG. 1, the assembly 10 may include a jar assembly 12 and a lid assembly 14. An implement 16 including an applicator 18 and a handle 20 may be disposed in a recess in the lid assembly 14. As will be described in more detail below, the implement 16 may be releasably secured to the assembly 10 through a magnet coupling between a portion of the implement 16 and the lid assembly 14. The jar and lid assembly 10 in FIG. 1 is shown in a closed position with lid assembly 14 covering jar assembly 12. The jar and lid assembly 10 may have a generally cylindrical shape. However, it is contemplated that the jar and lid assembly 10 may have any shape desired, such as, but not limited to cubic, prisms, cones, pyramids, spheres, etc.

Figure 2:
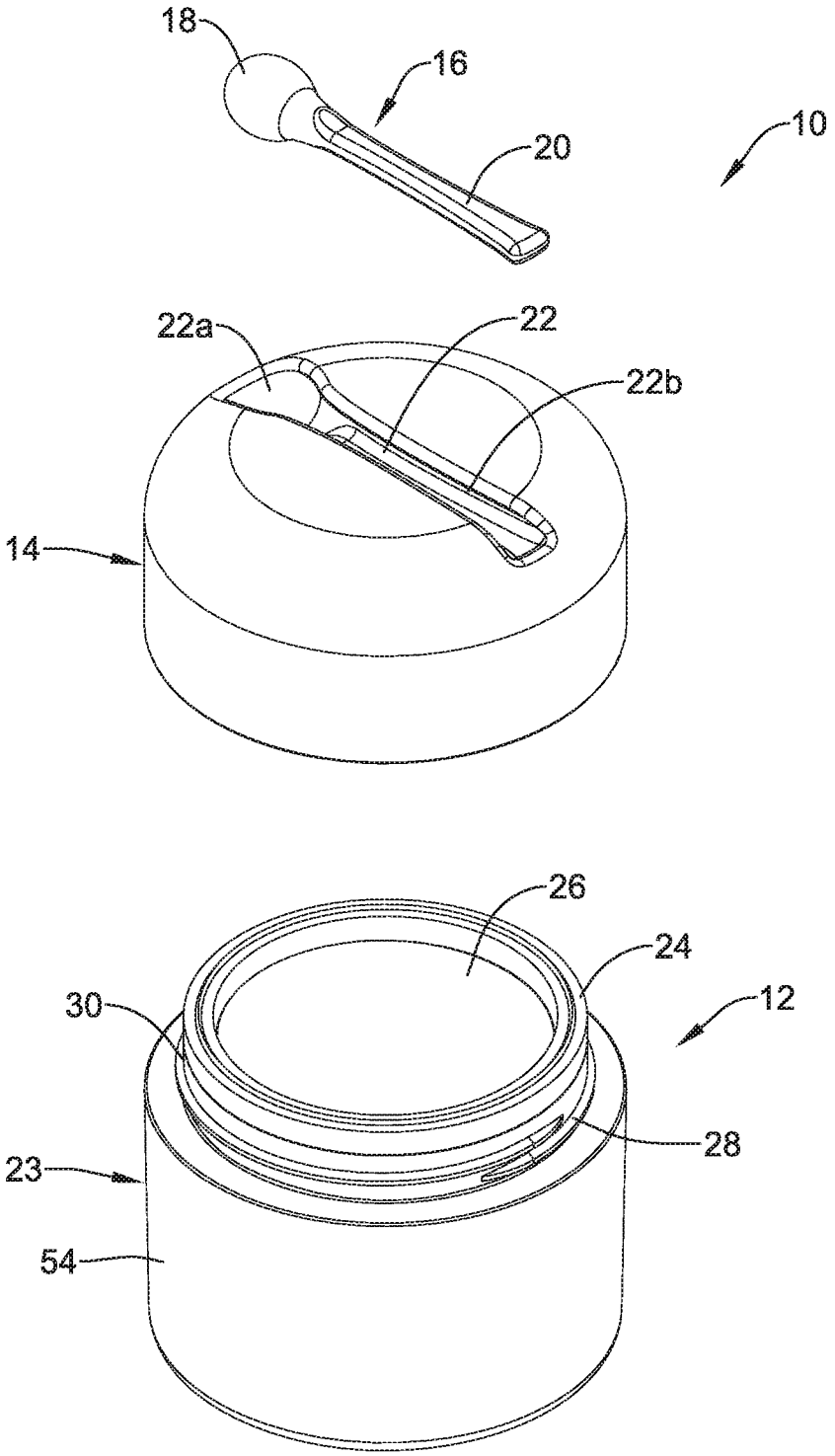
FIG. 2 is a partially exploded view of the illustrative jar and lid assembly of FIG. 1.

FIG. 2 is partially exploded view of the illustrative jar and lid assembly 10 shown in FIG. 1. As shown in FIG. 2, the lid assembly 14 may include a groove or recess 22 for receiving the implement 16. It is contemplated that the recess 22 may be sized and shaped to generally conform to a shape of the implement 16, as shown in FIG. 2, or may have a varying cross-sectional shape along a length of the recess 22, although this is not required. For example, the recess 22 may have a region 22*a* sized and shaped to receive the applicator 18 and a region 22*b* sized and shaped to receive the handle 20. In some embodiments, the recess 22 may be sized and shaped to receive a variety of implements 16 of differing sizes and shapes. For example, the recess 22 may be a channel having a generally uniform cross-section extending across, or partially across, a diameter of the lid assembly 14. This is just an example. The recess 22 may take any shape desired.

The jar assembly 12 may include an outer pot 23 and an inner pot 24. The outer pot 23 may provide support for the lid assembly 14 relative to the jar assembly 12. The outer pot 23 may be configured to house the inner pot 24. For example, as more clearly shown at FIG. 4, portions of the outer pot 23 may enclose the bottom of the inner pot 24 and the circumferential side of the inner pot 24. The term "house" used herein may, however, refer to any portion of outer pot 23 being adjacent to, coupled to, enclosing or covering any portion of inner pot 24. The inner pot 24 may be include a cavity 26 for holding a product. In some embodiments, the inner pot 24 may not be present and the product may be provided in the cavity 34 of the outer pot 23.

The outer pot 23 may have a body portion 54 and a neck portion 30. As can be seen in more detail in FIGS. 3 and 4, the neck portion 30 of the outer pot 23 may include a region for coupling the inner pot 24 and the outer pot 23. The neck portion 30 may include one or more grooves or threads 28 configured to engage a mating thread or groove on the lid assembly 14 to secure the lid assembly 14 to the jar assembly 12. Thus the lid assembly 14 may be rotatably coupled to the jar assembly 12 using such threads in some examples. However, other closure mechanisms may be used to secure the jar assembly 12 and the lid assembly 14 together. For example, the closure mechanism may be a snap fastening mechanism or a clamp fastening mechanism. These are just examples.

Embodiments may include any number of thread arrangements (e.g., single threading, double threading, triple threading, etc.) Embodiments may, however, be well suited for multiple numbers of thread arrangements (more than single threading) to facilitate providing a substantially air tight seal. For example, double threading may provide multiple starting points when inner lid threads start to rotatively engaging jar threads, which may provide a more even start of thread engagement between the lid and jar, provide less wobble and help to facilitate a substantially air tight seal.

Embodiments may also include restraints configured to stop rotation of the lid after rotating a predetermined number of degrees (e.g., 180 degrees) which may decrease the possibility of cross threading. Constraints may be located on jars or lids such that information (e.g., word, pictures, logos and the like) may be in a predetermined orientation (right side up) with respect to hinges or another elements of jar and lid assemblies.

Figure 3:
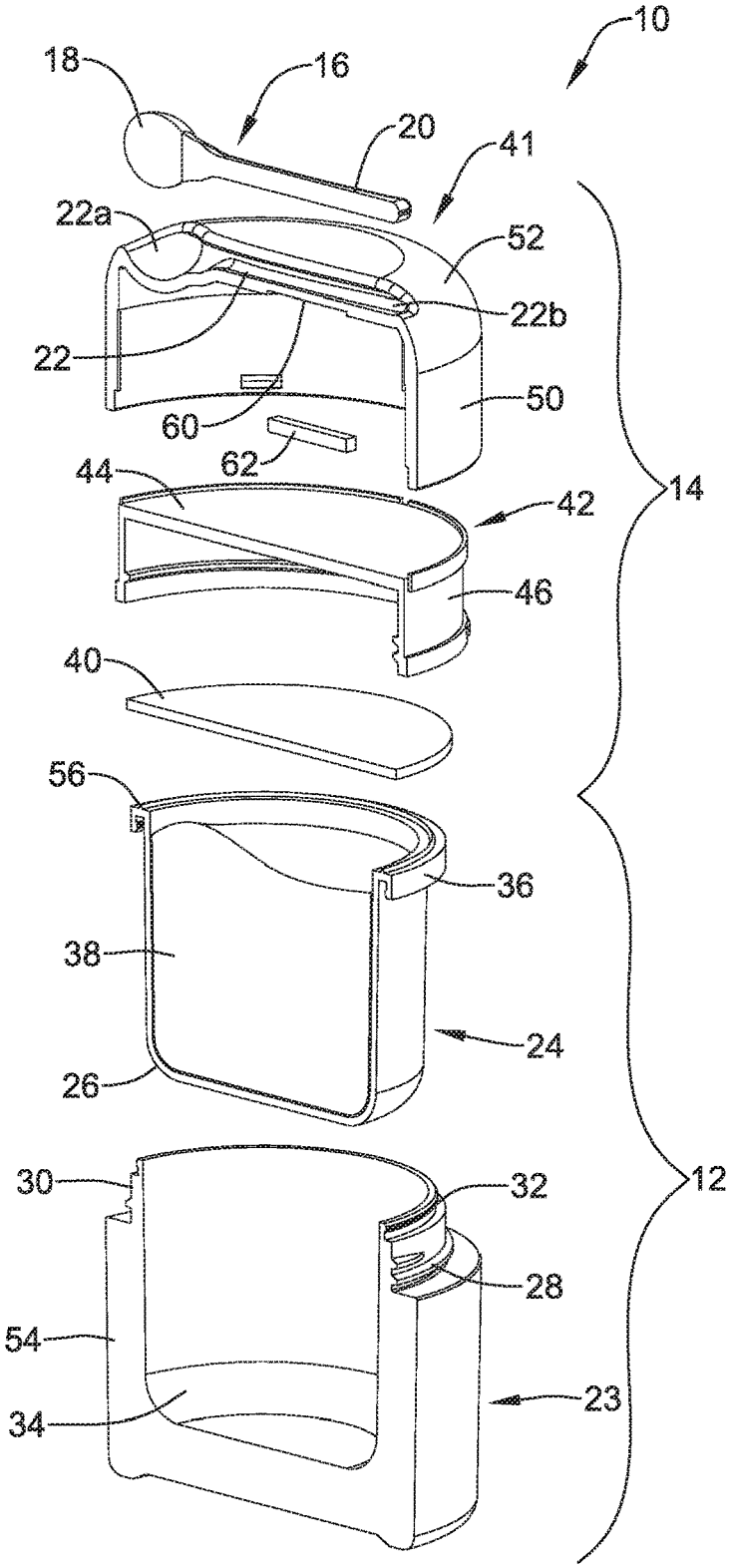
FIG. 3 is a cross sectional, exploded view of the illustrative jar and lid assembly shown in FIG. 1, taken at line A-A in FIG. 1.
Figure 4:
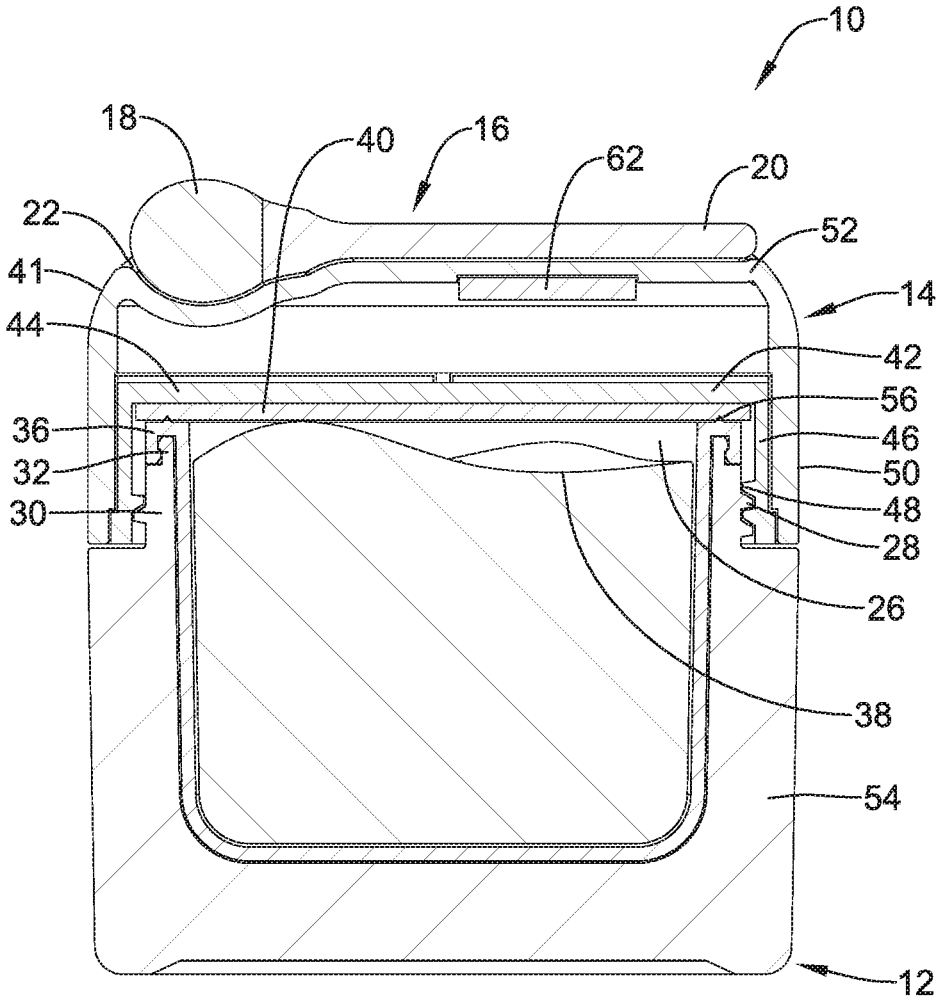
FIG. 4 is a cross sectional view of the illustrative jar and lid assembly shown in FIG. 1, taken at line A-A in FIG. 1.

FIG. 3 is a cross-sectional exploded view of the illustrative jar and lid assembly 10 shown in FIG. 1 taken at line A-A. FIG. 4 is a cross-sectional view of the assembled illustrative jar and assembly taken at line A-A of FIG. 1. The outer pot 23 may include a cavity or recess 34 for receiving the inner pot 24. The inner pot 24 may be removably disposed within the cavity 34, although this is not required. It is contemplated that the outer pot 23 may be coupled to the inner pot 24 through coupling means such as ultrasonic welds, glue, friction fit, and the like. In some embodiments, the inner pot 24 may include a flange or lip 36 configured to engage an upper edge 32 of the outer pot 23. This flange 36 may engage the upper edge 32 to maintain the inner pot 24 in a desired orientation. The inner pot 24 may be substantially the same size as the cavity 34 in the outer pot 23 or may be smaller, as desired. As described above, the inner pot 24 may include a cavity 26 configured to hold a product 38. Exemplary jar and lid assemblies may be used to hold any type of product 38, but may be particularly well suited for cosmetics that may include, but are not limited to loose powders (e.g., for eye, cheek, face, and the like), creams (e.g., skincare, eye, foundation, and the like), sunscreen, hot pour products (e.g., lipsticks, glosses, and the like), touchup, spot cover, baked powders, moisturizers, hair creams, gels, serums, and the like.

In some embodiments, the jar assembly 12 may be made from a rigid material (e.g., polymer, glass, metal, alloy, wood, stone, and the like). Other embodiments may, however, include jars made from a flexible or semi-rigid material, such as plastic. In some embodiments, the inner and/or outer pots 23, 24 may comprise a transparent or translucent material so that the cosmetic product within may be externally viewed.

As shown in FIGS. 3 and 4, the lid assembly 14 may include an outer lid portion 41, an inner lid portion 42, and a liner 40. In some instances, the outer lid portion 41, inner lid portion 42, and liner 40 may be formed as separate components that are coupled together. The outer lid portion 41, the inner lid portion 42, and/or the liner 40 may be coupled together using other coupling techniques, including fasteners, snaps, adhesives, ultrasonic welding, and the like. Alternatively, or additionally, two or more of the outer lid portion 41, inner lid portion 42, and liner 40 may be formed as a unitary structure. The outer lid portion 41 may include a top portion 52 and a laterally extending circumferential side 50. The laterally extending side 50 may be generally perpendicular to the top portion 52.

The recess 22 may be formed in an outer surface of the top portion 52. In some embodiments, the recess 22 may be formed at the same time as the outer lid portion 41. For example, the recess 22 may be molded with the outer lid portion 41. In other embodiments, the recess 22 may be formed by removing material from the outer lid portion 41. For example, the recess 22 may be cut or etched into the outer lid portion 41.

The inner lid portion 42 may include a top portion 44 and a laterally extending circumferential side 46. The laterally extending side 46 may be generally perpendicular to the top portion 44. The inner lid portion 42 may further include one or more grooves or threads 48 on an inner surface of the circumferential side 46. The threads 48 may be configured to engage the one or more threads 28 on the outer pot 23.

In some embodiments, the inner lid portion 42 may be releasably or fixedly secured to the outer lid portion 41. For example, the inner lid portion 42 may be snap fit with the outer lid portion 41. The top portion 44 of the inner lid portion 42 may be spaced from the top portion 52 of the outer lid portion 41 to provide a gap therebetween, although this is not required. The liner 40 may be configured to be disposed on an underside of the inner lid portion 42. For example, the liner 40 may be sized and shaped to be positioned against an inner surface of the top portion 44 such that the liner 40 is disposed between the inner lid portion and the jar assembly 12 (see, for example, FIG. 4).

While the lid assembly 14 is described as including an outer lid portion 41 and an inner lid portion 42, it is contemplated that the lid assembly may be a single unitary structure having a liner 40 disposed on or adjacent to an inner surface thereof. For example, the lid assembly 14 may be formed without the inner lid portion 42. In such an instance, the outer lid portion 41 may be provided with threading configured to mate with the threading on the jar assembly 12.

In some instances, the liner 40 may be configured to engage a raised bump or protrusions 56 extending around a perimeter of the inner pot 24, although this is not required. The liner 40 may be formed of a compliant or flexible material such that when the jar and lid assembly 10 is in the closed configuration, the liner 40 may provide a generally airtight seal. Exemplary liners may include, but are not limited to, materials such as polyethylene (low-density polyethylene, medium-density polyethylene, high-density polyethylene), expanded polyethylene, polyethylene terephthalate, silicone, rubber, polypropylene, polyoxymethylene, and acrylonitrile butadiene styrene. In other embodiments, liners may be integrated via manufacturing techniques such as overmolding, or may alternatively be integrated via features in the inner lid (such as sealing ribs).

The lid assembly 14 may further include a magnet 62 disposed on, embedded in, attached to, or otherwise a part of an underside 60 of the outer lid portion 41 between the outer lid portion 41 and the inner lid portion 42. The magnet 62 may be positioned under the recess 22 in a location generally corresponding to a location **22*b* where the handle 20 of the implement 16 would be located. This is just an example. The magnet 62 may be positioned to correspond to any portion of the implement 16 having magnet properties. For example, a metallic ferrule (not explicitly shown) may be used to couple the applicator 18 to the handle 20**.

In some embodiments, the magnet 62 may be formed as a part of the outer lid portion 41 via manufacturing techniques such as overmolding. In other embodiments, the magnet 62 may be attached to the underside 60 of the outer lid 41 using glue, adhesives, or other attachment mechanisms. In yet other embodiments, the magnet 62 may mechanically engage features formed into the outer lid portion 41. For example, the magnet 62 may be press-fit into a recess on the underside 60 of the outer lid portion 41. It is contemplated that the magnet 62 may be a single magnet or a plurality of magnets.

In some instances, the handle 20 of the implement 16 may be formed from a magnetic material. The magnetic attraction between the handle 20 and the magnet 62 in the lid assembly 14 may releasably secure the implement 16 to the lid and jar assembly 10. This may allow for an adherence between the implement 16 and the jar and lid assembly 10. In some embodiments, the handle 20 may be formed from a polymeric material with a magnet disposed within the polymeric material. Alternatively, or additionally, the handle 20 may be formed of a composite material. For example, magnetic particles may be dispersed throughout a non-magnetic material. Non-magnetic materials may include polymers, ceramics, non-magnetic metals, wood, stone, glass, or combinations thereof.

For each embodiment, the implement 16 is described in the context of an applicator for applying a product to a body. However, it should be understood that other implements may be magnetically coupled to a lid and jar assembly 10 or other storage device. The coupling mechanism as described herein may be used and adapted to other implements and/or storage containers, as desired. Some illustrative implements 16 may include but are not limited to an applicator with a handle, an applicator without a handle, a stencil (e.g., a brow stencil), tweezers, a brush with or without a handle, a sponge with or without a handle, a pencil, a vial, a lipstick, etc. Some illustrative storage containers may include jars, compacts, tubes, vials, etc.

In some embodiments, the applicator 18 may comprise natural bristles (hair, cellulose fibers, cotton, hemp, flax or composites thereof), synthetic bristles (e.g. plastic, silicone, latex or composites thereof), metallic bristles, flocking, silicone, rubber, sponge, pencil, or composites thereof. In some embodiments, the applicator 18 may itself have magnetic properties. For example, the applicator 18 may be a brush having one or more magnetic bristles, or a brush or flocking surrounding a magnetic core. In some embodiments, the applicator 18 may comprise a single material and in other embodiments it may comprise a combination of materials. In some examples, the applicator 18 shape may be substantially rounded, as illustrated in FIG. 1. The applicator 18 may be substantially squared, flat, slanted, rounded, beveled, pointed, curved, or any other shape.

Figure 5:
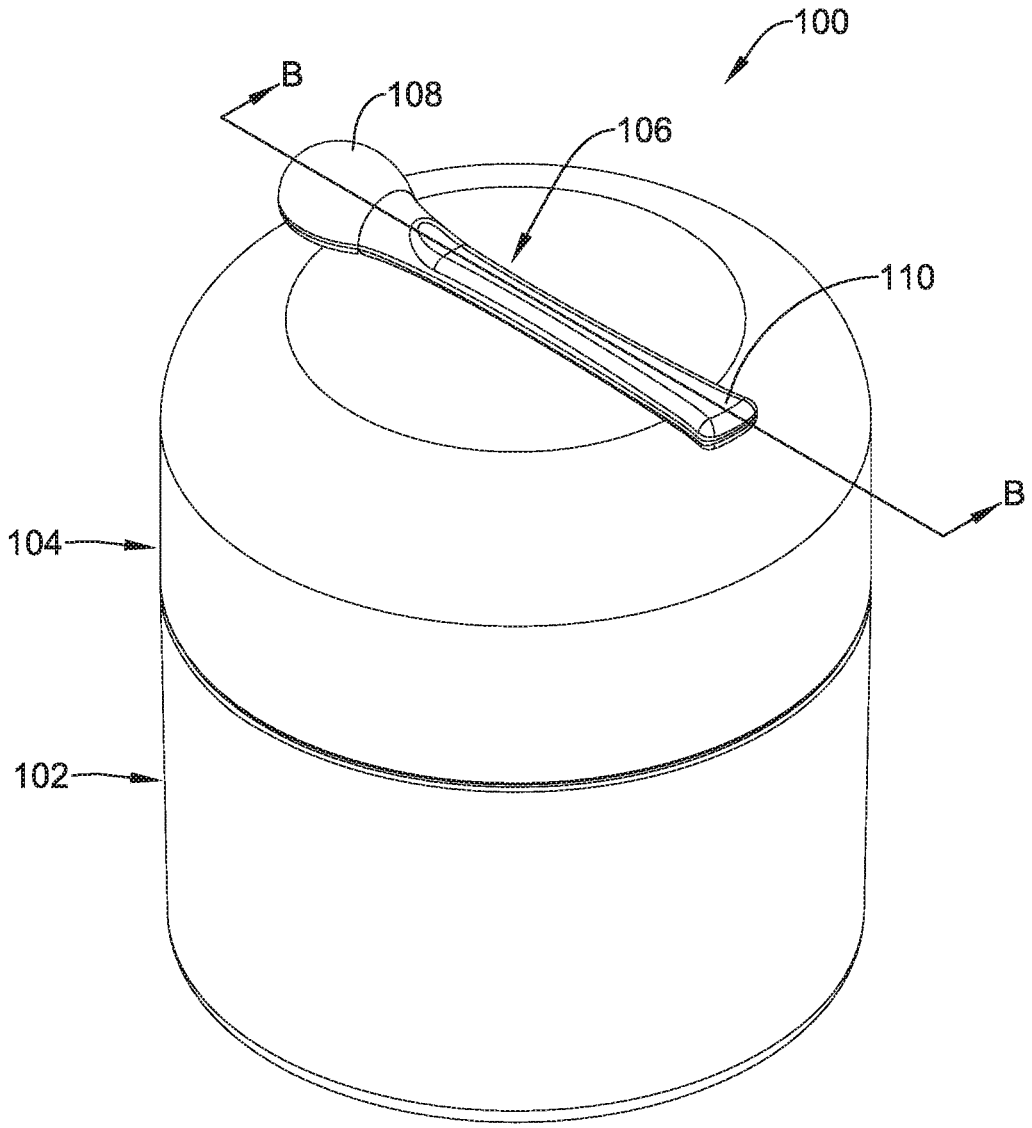
FIG. 5 is a perspective view of another illustrative jar and lid assembly.

FIG. 5 is a perspective view of ajar and lid assembly 100 according to another illustrative embodiment. As shown at FIG. 5, the assembly 100 may include a jar assembly 102 and a lid assembly 104. An implement 106 including an applicator 108 and a handle 110. As will be described in more detail below, the implement 106 may be releasably secured to the assembly 100 through a magnet coupling between a portion of the implement 106 and the lid assembly 104. The jar and lid assembly 100 in FIG. 5 is shown in a closed position with lid assembly 104 covering jar assembly 102. The jar and lid assembly 100 may have a generally cylindrical shape. However, it is contemplated that the jar and lid assembly 100 may have any shape desired, such as, but not limited to cubic, prisms, cones, pyramids, spheres, etc. The jar assembly 102 may be similar in form and function to the jar assembly 12 described above.

Figure 6:
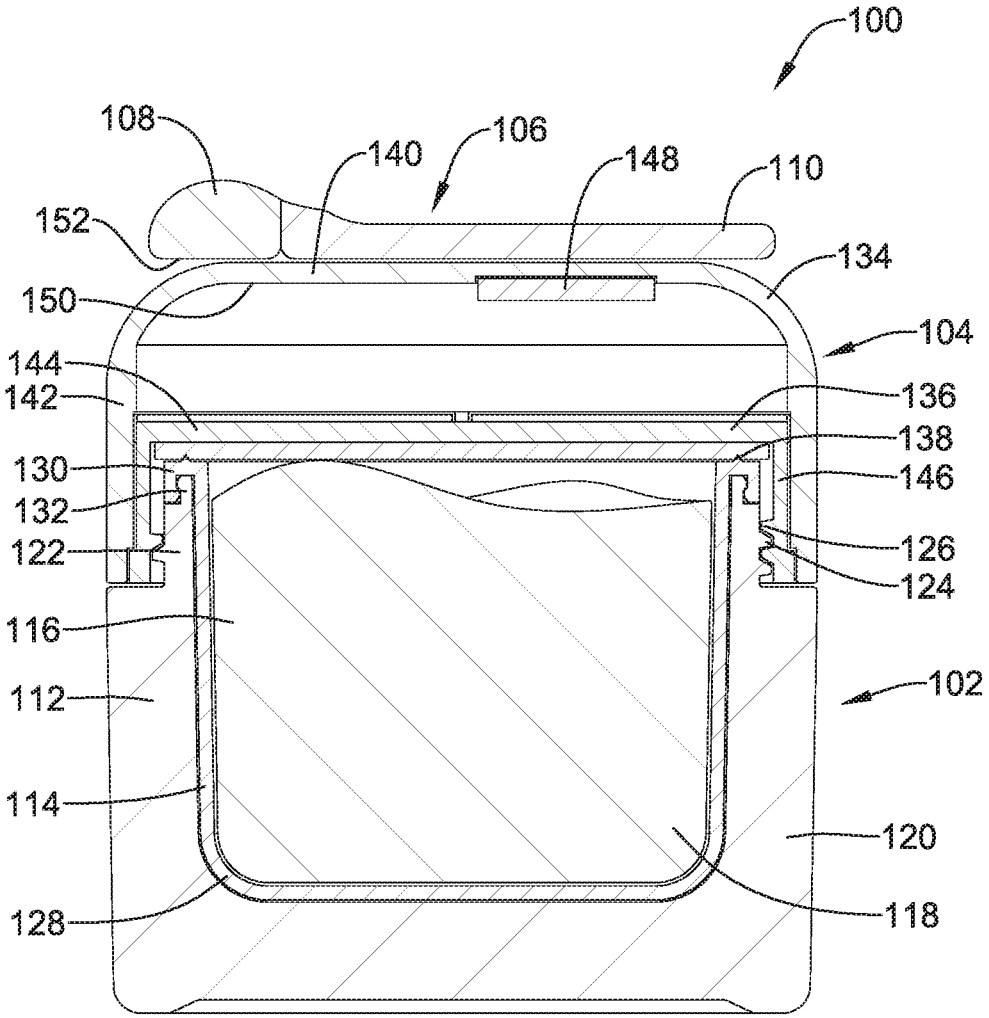
FIG. 6 is a cross-sectional view of the illustrative jar and lid assembly of FIG. 5, taken at line B-B.

FIG. 6 is a cross-sectional view of the illustrative assembly of FIG. 5, taken at line B-B. The jar assembly 102 may include an outer pot 112 and an inner pot 114. The outer pot 112 may provide support for the lid assembly 104 relative to the jar assembly 102. The outer pot 112 may be configured to house the inner pot 114. For example, portions of the outer pot 112 may enclose the bottom of the inner pot 114 and the circumferential side of the inner pot 114. The term "house" used herein may, however, refer to any portion of outer pot 112 being adjacent to, coupled to, enclosing or covering any portion of inner pot 114. The inner pot 114 may include a cavity 116 for holding a product 118. Exemplary jar and lid assemblies may be used to hold any type of product 118, but may be particularly well suited for cosmetics that may include, but are not limited to loose powders (e.g., for eye, cheek, face, and the like), creams (e.g., skincare, eye, foundation, and the like), sunscreen, hot pour products (e.g., lipsticks, glosses, and the like), touchup, spot cover, baked powders, moisturizers, hair creams, gels, serums, and the like. In some embodiments, the inner pot 114 may not be present and the product may be provided in the cavity 128 of the outer pot 112.

The outer pot 112 may have a body portion 120 and a neck portion 122. The neck portion 122 may include one or more grooves or threads 124 configured to engage a mating thread or groove 126 on the lid assembly 104 to secure the lid assembly 104 to the jar assembly 102. However, other closure mechanisms may be used to secure the jar assembly 102 and the lid assembly 104 together. For example, the closure mechanism may be a snap fastening mechanism or a clamp fastening mechanism. These are just examples.

Embodiments may include any number of thread arrangements (e.g., single threading, double threading, triple threading, etc.) Embodiments may, however, be well suited for multiple numbers of thread arrangements (more than single threading) to facilitate providing a substantially air tight seal. For example, double threading may provide multiple starting points when inner lid threads start to rotatively engaging jar threads, which may provide a more even start of thread engagement between the lid and jar, provide less wobble and help to facilitate a substantially air tight seal.

Embodiments may also include restraints configured to stop rotation of the lid after rotating a predetermined number of degrees (e.g., 180 degrees) which may decrease the possibility of cross threading. Constraints may be located on jars or lids such that information (e.g., word, pictures, logos and the like) may be in a predetermined orientation (right side up) with respect to hinges or another elements of jar and lid assemblies.

The outer pot 112 may include a cavity or recess 128 for receiving the inner pot 114. The inner pot 114 may be removably disposed within the cavity 128, although this is not required. It is contemplated that the outer pot 112 may be coupled to the inner pot 114 through coupling means such as ultrasonic welds, glue, friction fit, and the like. In some embodiments, the inner pot 114 may include a flange or lip 130 configured to engage an upper edge 132 of the outer pot 112. This flange 130 may engage the upper edge 132 to maintain the inner pot 114 in a desired orientation. The inner pot 114 may be substantially the same size as the cavity 128 in the outer pot 112 or may be smaller, as desired. In some embodiments, the jar assembly 102 may be made from a rigid material (e.g., polymer, glass, metal, alloy, wood, stone, and the like). Other embodiments may, however, include jars made from a flexible or semi-rigid material, such as plastic. In some embodiments, the inner and/or outer pots 112, 114 may comprise a transparent or translucent material so that the cosmetic product within may be externally viewed.

As shown in FIG. 6, the lid assembly 104 may include an outer lid portion 134, an inner lid portion 136, and a liner 138. In some instances, the outer lid portion 134, inner lid portion 136, and liner 138 may be formed as separate components that are coupled together. The outer lid portion 134, the inner lid portion 136, and/or the liner 138 may be coupled together using other coupling techniques, including fasteners, snaps, adhesives, ultrasonic welding, and the like. Alternatively, or additionally, two or more of the outer lid portion 134, inner lid portion 136, and liner 138 may be formed as a unitary structure. The outer lid portion 134 may include a generally planar top portion 140 which curves into a laterally extending circumferential side 142. The laterally extending side 142 may be generally perpendicular to the top portion 140.

The inner lid portion 136 may include a top portion 144 and a laterally extending circumferential side 146. The laterally extending side 146 may be generally perpendicular to the top portion 144. The inner lid portion 136 may further include one or more grooves or threads 126 on an inner surface of the circumferential side 146. The threads 126 may be configured to engage the one or more threads 124 on the outer pot 112.

In some embodiments, the inner lid portion 136 may be releasably or fixedly secured to the outer lid portion 134. For example, the inner lid portion 136 may be snap fit with the outer lid portion 134. The liner 138 may be configured to be disposed on an underside of the inner lid portion 136. For example, the liner 138 may be sized and shaped to be positioned against an inner surface of the top portion 144 such that the liner 138 is disposed between the inner lid portion and the jar assembly 102. In some instances, the liner 138 may be configured to engage a raised bump or protrusions (not explicitly shown) extending around a perimeter of the inner pot 114, although this is not required. The liner 138 may be formed of a compliant or flexible material such that when the jar and lid assembly 100 is in the closed configuration, the liner 138 may provide a generally airtight seal. Exemplary liners may include, but are not limited to, materials such as polyethylene (low-density polyethylene, medium-density polyethylene, high-density polyethylene), expanded polyethylene, polyethylene terephthalate, silicone, rubber, polypropylene, polyoxymethylene, and acrylonitrile butadiene styrene. In other embodiments, liners may be integrated via manufacturing techniques such as overmolding, or may alternatively be integrated via features in the inner lid (such as sealing ribs).

While the lid assembly 104 is described as including an outer lid portion 134 and an inner lid portion 136, it is contemplated that the lid assembly may be a single unitary structure having a liner 138 disposed on or adjacent to an inner surface thereof. For example, the lid assembly 104 may be formed without the inner lid portion 136. In such an instance, the outer lid portion 134 may be provided with threading configured to mate with the threading on the jar assembly 102.

The lid assembly 104 may further include a magnet 148 disposed on, embedded in, attached to, or otherwise a part of an underside 150 of the outer lid portion 134 between the outer lid portion 134 and the inner lid portion 136. The magnet 148 may be positioned on the underside 150 of the outer lid portion 134 at any location desired. In some instances, the magnet 148 may be offset from center of the outer lid portion, as shown in FIG. 6, although this is not required. For example, the magnet 148 may be positioned in a location generally corresponding to a location where the handle 110 of the implement 106 would be located when the implement 106 is placed on the top of the lid assembly 104, as shown in FIG. 6. This is just an example. The magnet 148 may be positioned to correspond to any portion of the implement 106 having magnet properties. For example, a metallic ferrule (not explicitly shown) may be used to couple the applicator 108 to the handle 110.

In some embodiments, the magnet 148 may be formed as a part of the outer lid portion 134 via manufacturing techniques such as overmolding. In other embodiments, the magnet 148 may be attached to the underside 150 of the outer lid 134 using glue, adhesives, or other attachment mechanisms. In yet other embodiments, the magnet 148 may mechanically engage features formed into the outer lid portion 134. For example, the magnet 148 may be press-fit into a recess on the underside 150 of the outer lid portion 134. It is contemplated that the magnet 148 may be a single magnet or a plurality of magnets.

In some instances, the handle 110 of the implement 106 may be formed from a magnetic material. The magnetic attraction between the handle 110 and the magnet 148 in the lid assembly 104 may releasably secure the implement 106 to the lid and jar assembly 100. This may allow for an adherence between the implement 106 and the jar and lid assembly 100. In some embodiments, the handle 110 may be formed from a polymeric material with a magnet disposed within the polymeric material. Alternatively, or additionally, the handle 110 may be formed of a composite material. For example, magnetic particles may be dispersed throughout a non-magnetic material. Non-magnetic materials may include polymers, ceramics, non-magnetic metals, wood, stone, glass, or combinations thereof. In some embodiments, the implement 106 may be formed such that one side thereof 152 has a generally flat or linear profile. This may allow the implement 106 to be easily placed against the lid assembly 104, as shown in FIG. 6.

For each embodiment, the implement 106 is described in the context of an applicator for applying a product to a body. However, it should be understood that other implements may be magnetically coupled to a lid and jar assembly 100 or other storage device. The coupling mechanism as described herein may be used and adapted to other implements and/or storage containers, as desired. Some illustrative implements 106 may include but are not limited to an applicator with a handle, an applicator without a handle, a stencil (e.g., a brow stencil), tweezers, a brush with or without a handle, a sponge with or without a handle, a pencil, a vial, a lipstick, etc. Some illustrative storage containers may include jars, compacts, tubes, vials, etc.

In some embodiments, the applicator 108 may comprise natural bristles (hair, cellulose fibers, cotton, hemp, flax or composites thereof), synthetic bristles (e.g. plastic, silicone, latex or composites thereof), metallic bristles, flocking, silicone, rubber, sponge, pencil, or composites thereof. In some embodiments, the applicator 18 may itself have magnetic properties. For example, the applicator 18 may be a brush having one or more magnetic bristles, or a brush or flocking surrounding a magnetic core. In some embodiments, the applicator 108 may comprise a single material and in other embodiments it may comprise a combination of materials. In some examples, the applicator 108 shape may be partially rounded, as illustrated in FIG. 6. The applicator 108 may be substantially squared, flat, slanted, rounded, beveled, pointed, curved, or any other shape.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A jar and lid assembly comprising:

a jar assembly comprising;

an outer pot having a body portion and a neck portion; and an inner pot configured to be positioned within the body portion of the outer pot, the inner pot including a cavity configured to hold a product;

wherein the neck portion of the outer pot includes a circumferential edge disposed at a top of the jar assembly defining an opening, and one or more threads on an outer side of the neck portion;

a lid assembly releasably coupled to the jar, the lid assembly comprising;

a top portion having an outer surface and an inner surface and a laterally extending side;

an inner lid portion having an upper surface and a circumferential side wall extending laterally away from the upper surface, the inner lid portion positioned below the top portion with the upper surface spaced apart from the inner surface of the top portion, creating a cavity therebetween, wherein only the side wall of the inner lid portion engages the top portion;

wherein the inner lid portion includes one or more threads on an inner side of the laterally extending side wall configured to engage with the one or more threads on the outer side of the neck portion of the outer pot to secure the lid assembly to the jar assembly;

a recess formed in the outer surface of the top portion of the lid assembly; and a magnet attached to the inner surface of the top portion of the lid assembly, in an upper region of the cavity defined between the top portion and the inner lid portion, wherein the magnet has a length and a width, the length being greater than the width, and the magnet is aligned with the recess.

2. The jar and lid assembly of claim 1, further comprising a cosmetic implement magnetically coupled to the outer surface of the top portion of the lid assembly.

3. The jar and lid assembly of claim 2, wherein the at least a part of the cosmetic implement is formed from a magnetic material.

4. The jar and lid assembly of claim 2, wherein the cosmetic implement comprises a handle and an applicator and at least one of the handle and the applicator of the cosmetic implement is formed from a composite material including at least one magnetic material.

5. The jar and lid assembly of claim 2, wherein the cosmetic implement comprises a handle and an applicator and at least one of the handle and the applicator of the cosmetic implement is formed from a polymeric material having a magnetic core.

6. The jar and lid assembly of claim 1, wherein the magnet is adhered to the inner surface of the top portion of the lid assembly.

7. The jar and lid assembly of claim 1, wherein the magnet is embedded in the inner surface of the top portion of the lid assembly.

8. The jar and lid assembly of claim 1, wherein the recess has a generally uniform cross-section along a length of the recess.

9. The jar and lid assembly of claim 1, wherein a cross-section of the recess changes along a length of the recess.

10. The jar and lid assembly of claim 1, further comprising a liner disposed adjacent to the inner lid portion of the lid assembly and configured to contact the circumferential edge of the jar assembly when the lid is in a closed position.

11. The jar and lid assembly of claim 1, wherein a recess is formed within the inner surface of the top portion of the lid assembly, the recess having a size and shape configured to receive the magnet.

12. The jar and lid assembly of claim 1, wherein inner lid portion fits within the top portion such that a bottom edge of the laterally extending side of the inner lid portion is aligned with a bottom edge of the laterally extending side of the top portion.

13. A jar and lid assembly comprising:

a jar assembly comprising;

an outer pot having a body portion and a neck portion; and an inner pot configured to be positioned within the body portion of the outer pot, the inner pot including a cavity configured to hold a product;

wherein the neck portion of the outer pot includes a circumferential edge disposed at a top of the jar assembly defining an opening, and one or more threads on an outer side of the neck portion; and a lid assembly releasably coupled to the jar, the lid assembly comprising:

an outer lid portion having an outer lid top portion having an elongate recess formed therein, the recess having a length and a width with the length being greater than the width;

an inner lid portion having an inner lid top portion with an upper surface, and a circumferential side wall extending laterally away from the upper surface, the upper surface of the inner lid portion being spaced apart from an inner surface of the outer lid portion, creating a cavity therebetween, wherein only the side wall of the inner lid portion engages the outer lid portion;

wherein the inner lid portion includes one or more threads on an inner side of the laterally extending side wall configured to engage with the one or more threads on the outer side of the neck portion of the outer pot to secure the lid assembly to the jar assembly;

a liner disposed adjacent to the inner lid portion of the lid assembly and configured to contact the circumferential edge of the jar assembly when the lid is in a closed position;

a magnet attached to the inner surface of the outer lid portion, in an upper region of the cavity defined between the outer lid portion and the inner lid portion, the magnet having a length and a width with the length being greater than the width, wherein the length of the magnet is aligned with the length of the recess; and a cosmetic implement configured to be disposed in the recess, the cosmetic implement magnetically coupled to a top surface of the outer lid portion.

14. The jar and lid assembly of claim 13, wherein a portion of the cosmetic implement is formed from a magnetic material.

15. The jar and lid assembly of claim 13, wherein a portion of the cosmetic implement is formed from a composite material including at least one magnetic material.

16. The jar and lid assembly of claim 13, wherein a portion of the cosmetic implement is formed from a polymeric material having a magnetic core.

17. The jar and lid assembly of claim 13, wherein the magnet is adhered to the inner surface of the outer lid portion.

18. The jar and lid assembly of 13, wherein the magnet is embedded in the inner surface of the outer lid portion.

19. The jar and lid assembly of claim 13, wherein a shape of the recess generally conforms to a shape of the cosmetic implement.

20. A jar and lid assembly comprising:

a jar assembly comprising;

an outer pot having a body portion; and an inner pot configured to be positioned within the body portion of the outer pot, the inner pot including a cavity configured to hold a product; and wherein the outer pot includes a circumferential edge disposed at a top of the jar assembly defining an opening, and one or more threads on an outer side of the outer pot; and a lid assembly releasably coupled to the jar, the lid assembly comprising:

an outer lid portion having a generally planar outer lid top portion with an outer surface and an inner surface;

an inner lid portion having an inner lid top portion with an upper surface, and a circumferential side wall extending laterally away from the upper surface, the inner lid portion positioned below the top portion with the upper surface spaced apart from the inner surface of the top portion creating a cavity therebetween, wherein only the side wall of the inner lid portion engages the outer lid portion;

wherein the inner lid portion includes one or more threads on an inner side of the laterally extending inner lid side wall configured to engage with the one or more threads on the outer side of the outer pot to secure the lid assembly to the jar assembly; and a magnet attached to the inner surface of the outer lid portion in an upper region of the cavity defined between the outer lid portion and the inner lid portion; and a cosmetic implement configured to be disposed on the generally planar outer lid top portion, the cosmetic implement including a magnet magnetically coupled to a top surface of the outer lid portion;

wherein at least a portion of the cosmetic implement has a profile configured to rest against the generally planar outer lid top portion.

* * * * *